United States Patent [19]

Sturdivan

[11] Patent Number: 4,558,980

[45] Date of Patent: Dec. 17, 1985

[54] MULTI-LEAVED TABLET AND METHOD OF FORMING SAME

[75] Inventor: James R. Sturdivan, Shawnee Mission, Kans.

[73] Assignee: Hallmark Cards, Inc., Kansas City, Mo.

[21] Appl. No.: 496,026

[22] Filed: May 19, 1983

[51] Int. Cl.[4] ..... B42C 9/00; G09F 1/00; B31D 5/00

[52] U.S. Cl. ..... 412/2; 40/124.1; 40/158 R; 229/92.8

[58] Field of Search ..... 412/2, 3, 6, 8; 40/158 R, 124.1; 229/92.8

[56] References Cited

U.S. PATENT DOCUMENTS

| | | | |
|---|---|---|---|
| 414,500 | 11/1889 | Cussons | 412/2 |
| 1,219,589 | 3/1917 | Schaefer | 412/2 |
| 1,777,448 | 10/1930 | Rader | 412/2 |
| 2,292,924 | 8/1942 | Bourke | 229/92.8 |
| 2,322,647 | 6/1943 | Luce | 412/2 |
| 2,897,523 | 8/1959 | Allegretti et al. | 412/2 |
| 3,203,125 | 8/1965 | Stoessel | 40/124.1 |
| 3,411,228 | 11/1968 | Lacey | 40/124.1 |
| 3,743,273 | 7/1973 | Katz et al. | 412/2 |
| 4,167,241 | 9/1979 | Zumbrunn | 229/92.8 |

*Primary Examiner*—Paul A. Bell
*Assistant Examiner*—Paul M. Heyrana, Sr.
*Attorney, Agent, or Firm*—Neuman, Williams, Anderson & Olson

[57] ABSTRACT

The multi-leaved tablet of this invention consists of leaves with corresponding surface portions adhesively interconnected and with corresponding surface portions free to fold relative to adjacent leaves. The leaves are of predetermined configuration and are die cut from a plurality of panels arranged so that they overlap. An area of adhesive interconnects portions of the surfaces of adjoining panels. This area has a rectilinear peripheral segment, and each die-cut leaf includes at least a portion of the rectilinear peripheral segment of the adhesive area. The rectilinear peripheral segment of the adhesive area is coincident with the folding axes of the leaves.

10 Claims, 10 Drawing Figures

FIG. 6
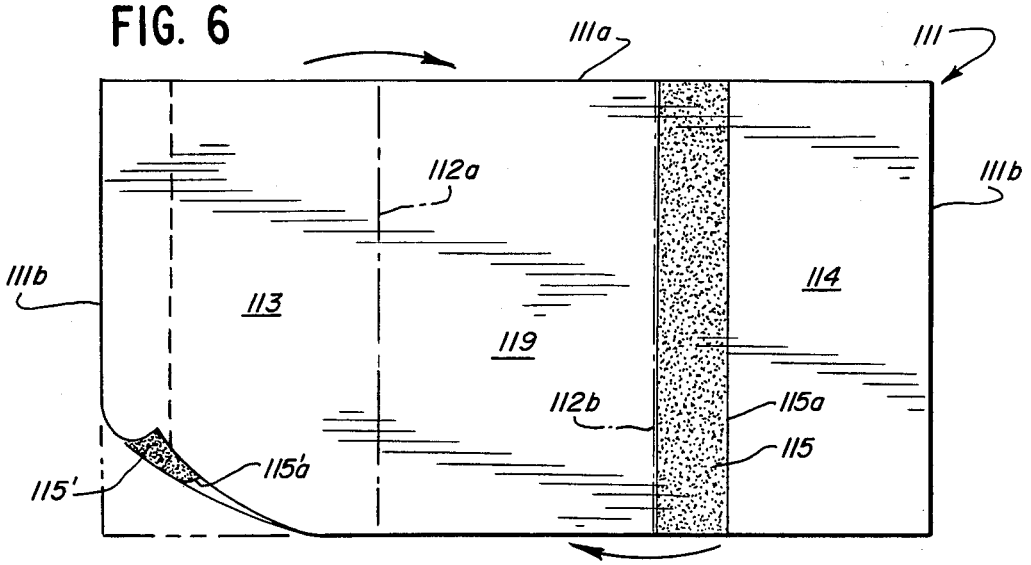
FIG. 7
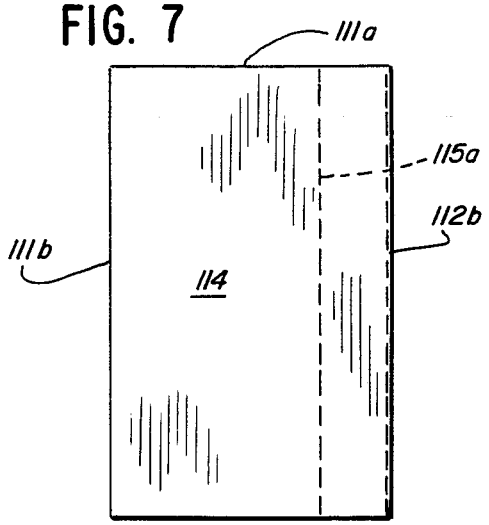
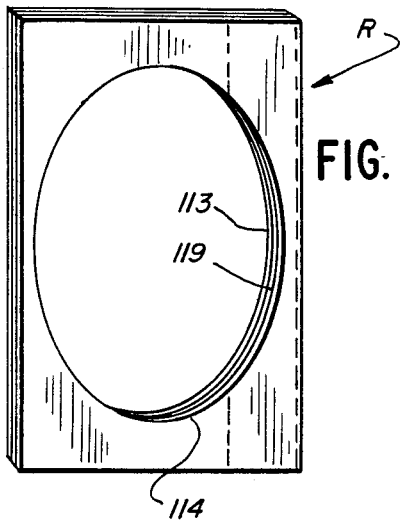
FIG. 8
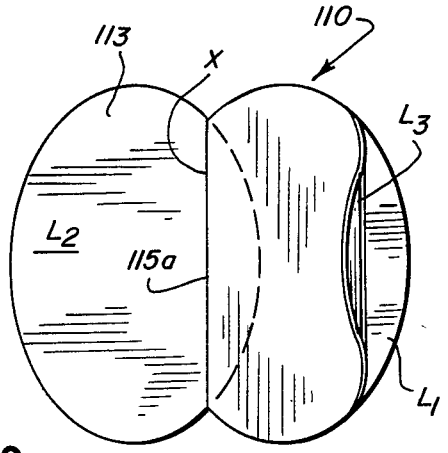
FIG. 9
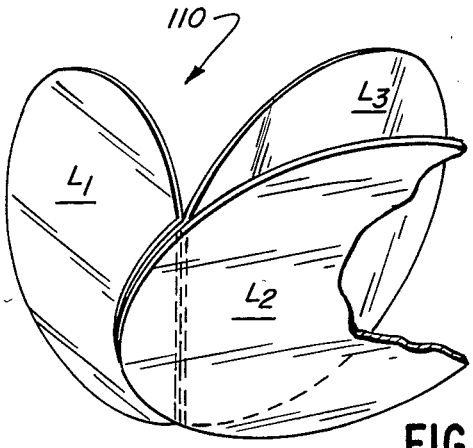
FIG. 10

MULTI-LEAVED TABLET AND METHOD OF FORMING SAME

BACKGROUND OF THE INVENTION

Heretofore in the manufacture of greeting cards and the like having multiple leaves, it has been customary for the periphery of the card leaves to have substantial corresponding rectilinear portions or flat side edges which are interconnected by a peripheral folding score or the like. By reason of this peripheral limitation, serious problems often arose when the periphery or silhouette of the card had an irregular configuration with no, or insufficient, rectilinear peripheral portions, so as to provide a satisfactory folding connection. Furthermore, because of the requirement that the card periphery or silhouette have a substantial rectilinear portion, the esthetic and innovative appeal of the card was restricted to a certain extent. Where the multi-leaved card silhouette lacked the desired flat peripheral edge, it was frequently necessary to utilize a connecting ring portion or rivet to secure the leaves together. In such an arrangement, however, maintaining the leaves in registered relation became extremely difficult and often detracted from the esthetic appeal of the card. Also, the utilization of rings, rivets, and the like increased the cost and complexity of the manufacturing operation.

SUMMARY OF THE INVENTION

Thus, it is an object of the invention to provide a multi-leaved tablet (e.g. greeting card) of the type described which avoids all of the aforenoted shortcomings associated with prior structures of this general type.

It is a further object to provide a method of making multi-leaved tablets of the type described which is simple, inexpensive, and expeditious.

It is a still further object of the invention to provide a multi-leaved tablet, the silhouette of which may be of substantially endless configurations, which are capable of being die cut.

Further and additional objects will appear from the description, accompanying drawings, and appended claims.

In accordance with one embodiment of the invention a multi-leaved tablet is provided wherein the leaves thereof are foldable relative to one another about coincident axes. The leaves are die-cut from a plurality of panels arranged in overlying face-to-face relation. Corresponding portions of the panel contacting surfaces are adhesively interconnected by areas of adhesive having rectilinear peripheral segments have at least portions thereof disposed within the areas of the leaves die-cut from the plurality of panels. The portions of the rectilinear segments are disposed in coincident relation with the folding axes of the leaves.

In forming a two-leaved tablet, for example, a blank of sheet material is utilized which is provided with a centrally disposed folding score so as to form a pair of panels. A stripe of adhesive is applied to a surface of one of the panels. One side edge of the adhesive stripe is rectilinear and is spaced a predetermined distance from a peripheral portion of the panel to which the stripe is applied. The blank is folded about the folding score so that the panels thereof are in face-to-face relation. The tablet of predetermined configuration is die-cut from the folded blank so that a predetermined portion of the rectilinear side edge of the adhesive stripe is included within the area of the die-cut tablet and is coincident to the folding axis of the tablet leaves.

DESCRIPTION

For a more complete understanding of the invention, reference should be made to the drawings wherein:

FIG. 6 is similar to FIG. 1 but showing a blank from which a three-leaved tablet is made.

FIG. 7 is similar to FIG. 2 but showing the blank of FIG. 6 in a folded state.

FIG. 8 is a perspective view of the folded blank of FIG. 7 but showing the remanant thereof after the three-leaved tablet has been die cut therefrom.

FIG. 9 is a top plan view of the tablet die-cut from the folded blank of FIG. 7 and showing certain of the leaves thereof in an unfolded relation and the center leaf partially turned back to expose the bottom leaf.

FIG. 10 is a perspective back view of the three-leaved tablet of FIG. 9 and showing the center and back leaves thereof in partial unfolded relation with respect to the front or cover leaf.

Figure 4:
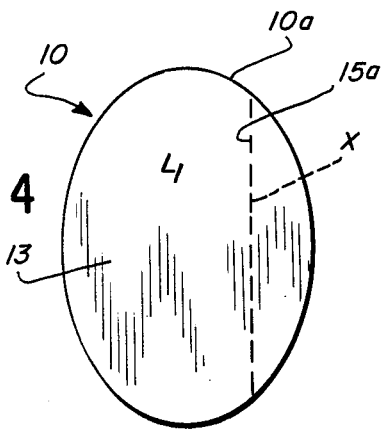
FIG. 4 is a top plan view of the tablet die-cut from the folded blank of FIG. 2.
Figure 5:
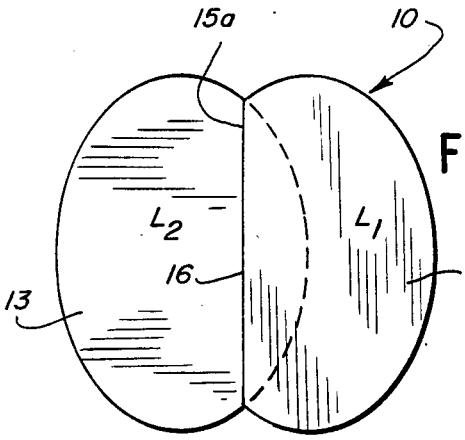
FIG. 5 is similar to FIG. 4 but showing the tablet with the leaves thereof in an unfolded relation.

Referring now to the drawings and more particularly to FIGS. 4 and 5, a two-leaved tablet 10 in the form of a greeting card is shown wherein the periphery 10*a* thereof, for purposes of illustration, is oval-shaped; that is to say that no segment of the periphery is flat-sided or rectilinear. It is to be understood, of course, that the peripheral configuration of the card 10 may vary substantially from that shown without departing from the scope of the invention to be hereinafter described. In some instances, not shown, the peripheral configuration may include a flat side, the length of which would not be sufficient to provide a stable folding axis for the leaves comprising the card. The number of leaves comprising the card may be two or more, as desired. FIG. 9 shows a three-leaved card 110 which is similar in many respects to card 10.

The method of forming card 10 or 110 is an inexpensive and expeditious operation which avoids the problems heretofore associated with multi-leaved cards having peripheral configurations with no flat sides or with flat sides of insufficient lengths. The card 10 is formed from a single blank 11 of suitable foldable sheet material, such as paperboard, having the surfaces thereof capable of readily accepting printed indicia or graphics. The blank 11 in the illustrated embodiment is of rectangular shape; however, it may assume other shapes if desired. Blank 11 is provided with a folding score 12 which is centrally disposed and extends transversely of the elongated sides 11*a* of the blank. The folding score 12 divides the blank into two panels 13, 14 of like configuration.

Applied to one surface of one of the panels is an area of adhesive which in the illustrated embodiment is in the form of a wide stripe 15. The stripe is shown applied to the surface of panel 14 and is disposed adjacent to the folding score 12. If desired, the stripe 15 can be applied in a similar location on the surface of panel 13, or adjacent the edge 11*b* of either panel. This latter alternative is shown in phantom lines on panel 14. The forming of blank 11, folding score 12, and the application of the stripe of adhesive 15 can be readily accomplished by conventional high-speed cut, scoring, and gluing apparatus well known in the art.

It is important to note than whichever portion of the blank the adhesive area or stripe 15 is located, the area should have a rectilinear peripheral segment 15*a* which is spaced inwardly a substantial distance d from a peripheral portion of the panel surface to which the adhesive area is applied. In the illustrated embodiment, the peripheral segment 15*a* is spaced from and is substantially parallel to folding score 12. Where, however, the area is adjacent panel edge 11*b*, the segment 15*a* is spaced inwardly therefrom and is substantially parallel thereto. The reasons for the adhesive area peripheral segment 15*a* being rectilinear and spaced inwardly a substantial distance d will become apparent hereinafter.

When the adhesive area 15 is adjacent either the folding score 12 or panel edge 11*b*, the ultimate card 10 will have at least one of the leaves thereof foldable about a side axis which is coincident to the peripheral segment 15*a*. Where it is desired to have one of the leaves of the ultimate card or tablet foldable about an axis disposed at the top or bottom of the card, the adhesive area 15 will extend across the top or bottom of one or both of the blank panels 13, 14 and in a direction normal to the folding score 12.

Figure 1:
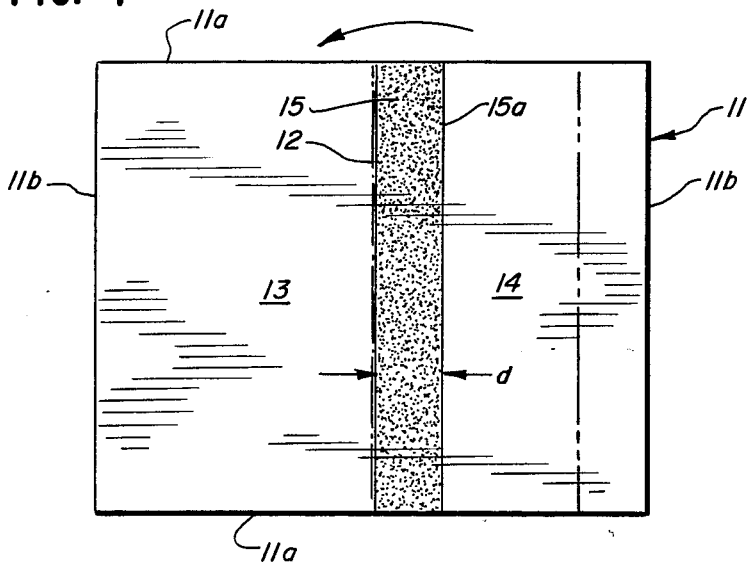
FIG. 1 is a top plan view of a blank of foldable sheet material from which a two-leaved tablet is made; the blank, as shown, includes a folding score and a stripe of adhesive.
Figure 2:
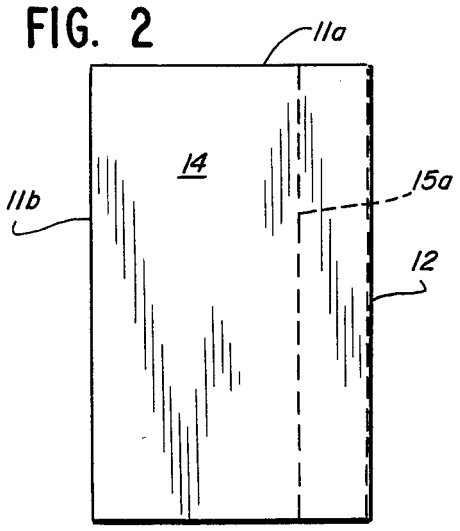
FIG. 2 is a top plan view of the blank of FIG. 1 in a folded state.
Figure 3:
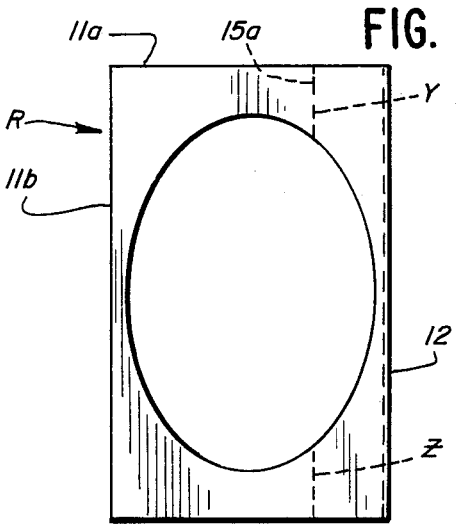
FIG. 3 is similar to FIG. 2 but showing the remnant of the blank after the two-leaved tablet has been die cut therefrom.

After the blank 11 has assumed the folded state, as shown in FIG. 2, the latter is subjected to die-cutting wherein the shape of the die-cutter is the same as the peripheral shape or silhouette of the tablet or card 10 desired. It is important that the location of the die-cutter (not shown) relative to the exposed surface of the folded blank, FIG. 2, be such that a substantial portion X of the rectilinear peripheral segment 15*a* of the area 15 be included within the area delimited by the die-cutter. The portions Y, Z of the rectilinear peripheral segment not included within the die-cut area can be readily observed from the remnant R of the blank shown in FIG. 3. To facilitate folding of the bottom leaf $L_1$ with respect to the top or cover leaf $L_2$, a second folding score 16, see FIG. 5, can be provided which is formed in blank panel 14 and is coincident to the rectilinear segment 15*a* of the stripe 15. The second folding score 16 should be formed in blank 11 before the latter assumes the folded state shown in FIG. 2. It will be noted in the finished card 10, FIG. 4, that the exposed surface of top or cover leaf $L_2$ is unmarked by any folding scores which might detract from its esthetic appearance. Furthermore, by having the exposed surface of the cover leaf $L_2$ unmarked, the printing indicia or graphics applied thereto are not distorted.

FIGS. 9 and 10 show a modified version of the multileaved tablet 110 which includes three leaves $L_1$, $L_2$, $L_3$ formed from the single blank 111, see FIG. 6. The blank 111 in the illustrated embodiment has a rectangular configuration; however, the elongated top and bottom edges 111*a* are longer than the corresponding edges of blank 11. Blank 111 is provided with a pair of parallel folding scores 112*a*, 112*b* which are arranged relative to the side edges 111*b* of the blank so that three panels 113, 114, 119 are formed which are of like configuration. Panel 114 has a stripe 115 of suitable adhesive applied to one surface thereof and panel 113 has a similar stripe 115' applied to an opposite surface thereof, see FIG. 6. It should be noted that stripe 115 is disposed adjacent to folding score 112*b* and that stripe 115' is disposed adjacent to side edge 111*b*. If desired, however, the locations of stripes 115 and 115' may vary from that shown provided that, when the panels 113, 114 are folded in opposite directions relative to center panel 119, the stripes will be disposed in coincident relation. As in the case of stripe 15, each stripe 115, 115' has a rectilinear peripheral segment 115*a*, 115'*a* which is spaced inwardly an amount d from either folding score 112*a* or 112*b*, and/or edges 111*a*, 111*b* of the blank. After the adhesive stripes 115, 115' have been applied, panels 113 and 114 are folded in opposite directions relative to the center panel 119 so as to be in face-to-face relation, see FIG. 7. The tablet (card) 110 is then die cut from the face-to-face surfaces of the panels 113, 119, 114 leaving a remnant R of the folded blank as seen in FIG. 8. As noted in FIG. 9, the portion X of the rectilinear peripheral segments 115*a*, 115'*a* are disposed in coincident relation with each other and the folding axes of the leaves $L_1$, $L_2$, and $L_3$. Leaf $L_2$ is preferably the front or cover leaf and the exposed surface thereof when the leaves of the card are in face-to-face relation has no visible indication of the folding axes of the leaves. If desired, however, leaf $L_2$ may be the back leaf. The number of leaves comprising the card will depend upon the number of folding scores formed in the blank 111. Additional folding scores may be formed in panels 114, 119 which are coincident to the peripheral segments 115*a*, 115'*a* and facilitate folding of leaves $L_1$, $L_3$ relative to leaf $L_2$.

As aforementioned, the peripheral configuration of the card 10 or 110 may vary widely from that shown. The folding manipulation of the blank panels to form the folded blank shown in FIGS. 2 and 7 may be readily performed by conventional folding apparatus well known in the art.

Thus, a multi-leaved tablet and method of forming same have been disclosed which are simple and inexpensive; the method can be expeditiously performed utilizing high-speed, conventional equipment; and the tablet is pleasing in appearance.

I claim:

1. A multi-leaved tablet wherein the leaves thereof are foldable relative to one another and have like predetermined peripheral configurations, said leaves being simultaneously die cut from a blank of foldable sheet material defining a plurality of foldably interconnected and formed panels having a predetermined peripheral configuration and arranged in contacting face-to-face relation, the contacting area of each panel surface being greater than the area of the leaf die cut therefrom, the peripheral configuration of the leaves differing from the peripheral configuration of the panels, the contacting surfaces of a pair of adjoining panels having corresponding sections thereof interconnected by an area of adhesive, said area including an elongated substantially rectilinear peripheral segment spaced inwardly from a peripheral portion of the contacting surface of each die-cut leaf, said rectilinear peripheral segment coinciding with the folding axis of said leaves.

2. The tablet of claim 1 wherein said blank has adjoining panels thereof separated by a folding score spaced from the leaves which are die cut from the panels.

3. The tablet of claim 1 wherein at least one of the adjoining adhesively connected panels is provided with a folding score disposed in substantially coincident relation to the rectilinear peripheral segment of said adhesive area.

4. The tablet of claim 1 wherein the rectilinear peripheral segment of said adhesive area is non-continuous and at least a portion thereof is spaced inwardly from the corresponding peripheral portions of the contacting surfaces of said die cut leaves.

5. The tablet of claim 1 wherein the die-cut interconnected leaves coact to form a greeting card having a cover leaf with the folding axis thereof not observable from the exposed surface of the cover leaf when the leaves are disposed in face-to-face relation.

6. A method of forming a multi-leaved tablet wherein the leaves thereof are foldable relative to one another and having corresponding surface portions adhesively interconnected, said method comprising arranging a plurality of panels of predetermined configuration in substantially overlapping face-to-face engagement, one panel of each pair of adjoining panels having an area of adhesive previously applied to a contacting surface thereof and said area having a rectilinear peripheral segment spaced inwardly from a peripheral portion of the contacting surface of said one panel, said adhesive area effecting adhesive interconnection of the adjoining panels; die-cutting the adhesively interconnected panels while in face-to-face relation to form therefrom a plurality of leaves of predetermined configuration so that a section of the contacting surface of each leaf will include at least a corresponding portion of the rectilinear peripheral segment of the adhesive area and such corresponding portion is spaced inwardly from the leaf periphery and coincides with the folding axis of the interconnected leaves, the predetermined configuration of said die-cut leaves differing from the configuration of said panels.

7. A method of forming a multi-leaved tablet from a blank of foldable sheet material whereby the leaves thereof are foldable relative to one another and have corresponding surface portions adhesively interconnected, said method comprising forming at least one folding score in a surface of the blank so as to form two adjoining panels; applying an area of adhesive to the surface of one of the adjoining panels, said adhesive area having a rectilinear peripheral segment spaced inwardly from a peripheral portion of said panel surface; folding said adjoining panels into overlapping face-to-face relation whereby corresponding surface portions of said adjoining panels are adhesively interconnected; and die-cutting from the adhesively interconnected panels leaves of predetermined configuration so that each leaf includes at least a corresponding portion of the rectilinear peripheral segment of the adhesive area and such corresponding portion coincides with the folding axis of the interconnected leaves.

8. The method of claim 7 wherein a pair of spaced substantially parallel folding scores are formed in a surface of the blank whereby panels of substantially like configuration are arranged in side-by-side relation so as to form a center panel and two end panels; applying areas of adhesive on opposite sides of said blank and to predetermined panel surfaces, each adhesive area having a corresponding linear peripheral segment spaced inwardly from a peripheral portion of the panel surface; folding the end panels of the blank in opposite directions relative to the center panel whereby the end panels are adhesively interconnected to opposite surfaces of said center panel and the linear peripheral segments of the adhesive areas are disposed in coincident relation; the adhesively interconnected panels are die-cut and form leaves of like predetermined configuration, each leaf including within a surface thereof at least a portion of the linear peripheral segment of the adhesive area interconnecting the leaf to an adjacent leaf.

9. The method of claim 8 wherein the adhesive areas are applied to opposite surfaces of the center panel and adjacent one of the pair of folding scores.

10. The method of claim 8 wherein the adhesive area is applied to one surface of the blank adjacent a folding score between said center panel and one end panel, and the other adhesive area is applied to opposite surface of the blank and adjacent the free edge of the other end panel whereby, when said end panels are folded relative to said center panel, said adhesive areas are disposed in substantially superposed coincident relation.

* * * * *